US012193524B2

(12) United States Patent
Razdan et al.

(10) Patent No.: US 12,193,524 B2
(45) Date of Patent: Jan. 14, 2025

(54) POST-SURGERY MASTECTOMY BRA

(71) Applicant: CAREANDWEAR II, INC., New York, NY (US)

(72) Inventors: Chaitenya Razdan, New York, NY (US); Rachel Sax Ramos, New York, NY (US)

(73) Assignee: CareandWear II, Inc., New York, NY (US)

( * ) Notice: Subject to any disclaimer, the term of this patent is extended or adjusted under 35 U.S.C. 154(b) by 294 days.

(21) Appl. No.: 17/427,140

(22) PCT Filed: Mar. 11, 2020

(86) PCT No.: PCT/US2020/022145
§ 371 (c)(1),
(2) Date: Jul. 30, 2021

(87) PCT Pub. No.: WO2020/190592
PCT Pub. Date: Sep. 24, 2020

(65) Prior Publication Data

US 2022/0095703 A1 Mar. 31, 2022

Related U.S. Application Data

(60) Provisional application No. 62/819,269, filed on Mar. 15, 2019.

(51) Int. Cl.
*A41C 3/00* (2006.01)

(52) U.S. Cl.
CPC ..... *A41C 3/0064* (2013.01)

(58) Field of Classification Search
CPC ..... A41C 3/0064; A41C 3/148; A41D 1/22
USPC ..... 450/82
See application file for complete search history.

(56) References Cited

U.S. PATENT DOCUMENTS

| | | | | |
|---|---|---|---|---|
| 561,427 | A * | 6/1896 | McKay | A41B 13/08 2/112 |
| 2,585,338 | A * | 2/1952 | Meares | A41C 3/04 450/86 |
| 5,429,593 | A * | 7/1995 | Matory | A61F 13/145 602/61 |
| 6,390,885 | B1 * | 5/2002 | Brooks | A41C 3/0064 450/3 |
| 6,786,798 | B1 | 9/2004 | Gendel | |
| D550,368 | S * | 9/2007 | Hankins | D2/706 |
| 9,545,124 | B1 | 1/2017 | Thompson | |
| 2004/0185748 | A1 * | 9/2004 | Gendel | A41C 3/02 450/100 |
| 2006/0031976 | A1 * | 2/2006 | Nwawka | A41D 13/1245 2/114 |
| 2020/0077718 | A1 * | 3/2020 | Thompson | A41D 13/1281 |
| 2021/0298367 | A1 * | 9/2021 | Song | A41C 3/02 |

* cited by examiner

*Primary Examiner* — Timothy K Trieu
(74) *Attorney, Agent, or Firm* — ArentFox Schiff LLP

(57) ABSTRACT

An article of clothing designed for use post-surgery, and in particular, post-mastectomy. The article of clothing may include a front portion, a back portion, and one or more strap portions, wherein the front portion comprises one or more side access portions. The article may further include a securing band proximal to the front and/or back portions, wherein the securing band includes one or more detachable band access portions, the one or more detachable band access portions being located near the one or more side access portions.

20 Claims, 2 Drawing Sheets

POST-SURGERY MASTECTOMY BRA

CROSS-REFERENCE TO RELATED APPLICATIONS

This application is a National Stage Entry of International Patent Application No. PCT/US2020/022145, filed Mar. 11, 2020, which claims priority to U.S. Provisional Patent Application No. 62/819,269, filed Mar. 15, 2019, the disclosures of which are hereby incorporated by reference in their entireties.

TECHNICAL FIELD

Aspects of the present disclosure are directed to an article of clothing configured for use post-surgery, and in particular, post-mastectomy.

BACKGROUND

Mastectomies are surgeries traditionally used for the treatment of breast cancer, resulting in the partial or complete removal of one or both breasts from a patient. Recovery from a mastectomy may be similar to the recovery from other types of surgery, including drainage of the surgical site(s) to remove blood and lymph to initiate the healing process. Mastectomy patients are also often observed for days after surgery, for example, in order to determine the level of swelling at and around surgical sites. A patient's movement is often limited during recovery, thereby inhibiting access to surgical sites, which is required for drain cleaning and observation. There is thus an unmet need in the art for an article of clothing that provides both comfort for a patient recovering from a mastectomy as well as acceptable access to surgical sites, particularly in cases wherein a patient's mobility may be limited.

SUMMARY

Aspects of the present disclosure are directed an article of clothing configured for use post-surgery, and in particular, post-mastectomy. The article of clothing may comprise a front portion, a back portion, and one or more strap portions, wherein the front portion comprises one or more side access portions. The article may further comprise a securing band proximal to the front and/or back portions, wherein the securing band comprises one or more detachable band access portions, the one or more detachable band access portions being in communication with the one or more side access portions.

Additional advantages and novel features of these aspects will be set forth in part in the description that follows, and in part will become more apparent to those skilled in the art upon examination of the following or upon learning by practice of the disclosure.

DETAILED DESCRIPTION

Aspects of the present disclosure are directed an article of clothing configured for use post-surgery, and in particular, post-mastectomy. The article of clothing may comprise a front portion, a back portion, and one or more strap portions, wherein the front portion comprises one or more side access portions. The article may further comprise a securing band proximal to the front and/or back portions, wherein the securing band comprises one or more detachable band access portions, the one or more detachable band access portions being in communication with the one or more side access portions.

According to some aspects, the article of clothing may comprise a bra. As interchangeably used herein, the term "bra" or "brassiere" may refer to an article of clothing configured to be worn on at least the upper portion of a wearer's torso, and in particular, to support the wearer's breasts. The bra may be configured for use post-surgery, and in particular, post-mastectomy. As used herein, the term "mastectomy" refers to a procedure wherein breast tissue is removed. According to some aspects, a mastectomy may refer to a total mastectomy, wherein an entire breast is removed, or a partial mastectomy, wherein a portion of a breast is removed. A mastectomy may also refer to a radical mastectomy, wherein an entire breast, underarm lymph nodes, and chest wall muscles under the breast are removed; a modified radical mastectomy, wherein an entire breast and a portion of underarm lymph nodes are removed; or a nipple-sparing mastectomy, wherein all of the breast tissue is removed without removal of the nipple.

The article of clothing may comprise a front portion, a back portion, and one or more strap portions. As used herein, the term "front portion" refers to a portion of the article configured to be worn on an anterior side of a wearer (e.g., the chest of a wearer). The term "back portion" refers to a portion of the article configured to be worn on a posterior side of a wearer (e.g., the back of a wearer). It should be understood that "front" and "back" as used herein are not particularly limiting. For example, the "back portion" as described herein may be worn on the anterior side of the wearer if, for example, the article is configured to be reversible.

Figure 1A:
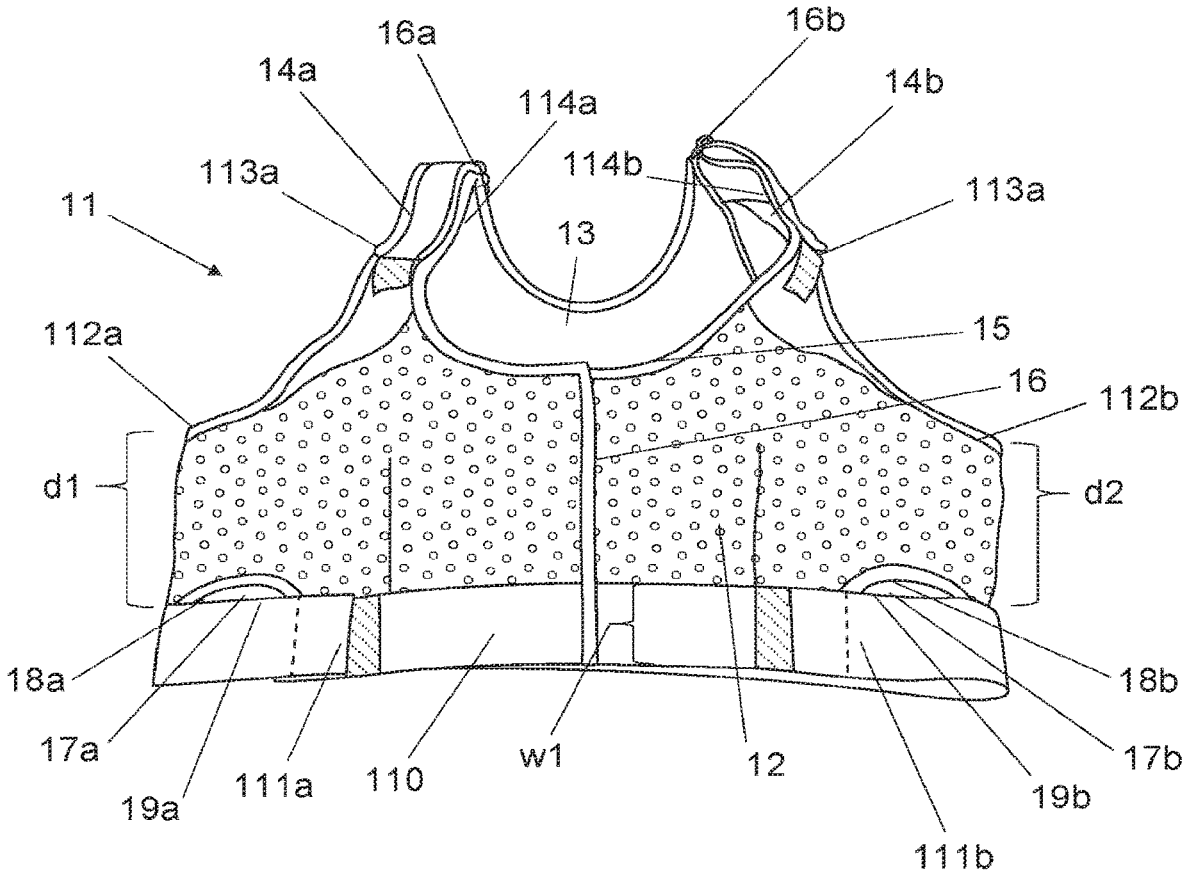
FIG. 1A shows a front side view of an article according to aspects of the present disclosure.

FIG. 1A shows an example front portion 12 of article 11 according to aspects of the present disclosure. As shown in FIG. 1A, front portion 12 may be connected with both back portion 13 and with two straps 14*a*, 14*b*. It should be understood that front portion 12, back portion 13, and straps 14*a*, 14*b* may be provided as discrete materials connected together (e.g., via stitching or other techniques in the art) and/or may be provided as one continuous material.

As shown in FIG. 1A, a neckline edge 15 of front portion 12 and inner edges 114*a*, 114*b* of straps 14*a*, 14*b* may together delineate a neck portion of the article, that is, an opening in the article configured for encompassing a wearer's neck.

Front portion 12 may be formed of a material suitable for use post-mastectomy. For example, according to some aspects, the material may have a sufficient texture for contact with surgical sites (e.g., sufficient smoothness so as not to disrupt or irritate surgical incisions). According to some aspects, the material may have a sufficient breathability, that is, may allow a sufficient level of air-flow to and from surgical sites (e.g., to enhance healing). Examples of materials useful according to aspects of the present disclosure include, but are not limited to, mesh fabrics, nylon, spandex, polyester, cotton, and combinations thereof. It should be understood that any material described herein may comprise an antimicrobial component. For example, any material described herein may be treated with an antimicrobial agent sufficient to provide the article with acceptable antimicrobial properties for surgery recovery.

Straps 14*a*, 14*b* may be comprised of a material that is the same as or different from the material comprised by front portion 12. For example, materials useful for straps 14*a*, 14*b* according to aspects of the present disclosure include, but are not limited to, mesh fabrics, nylon, spandex, polyester, cotton, metals, plastics, rubbers, fastener materials (e.g., hook-and-loop fasteners), and combinations thereof. According to some aspects, straps 14*a*, 14*b* may independently comprise an adjustable portion 16*a*, 16*b* configured such that straps 14*a*, 14*b* are adjustable. Adjustable portion 16*a*, 16*b* may independently comprise, for example, loops, as shown in FIG. 1A, and/or any other suitable fastener known in the art. For example, the faster may be selected from the group consisting of a tie, snap, button, fabric hook and loop fastener, zipper, buckle, hook and eye, cord, toggle, brooch, eyelet, and/or combinations of any of the foregoing. It should be understood that any suitable adjustable portion known in the art for providing adjustable straps may be selected for use with straps 14*a*, 14*b*.

As shown in FIG. 1A, front portion 12 may comprise a front access portion 16, which may be configured to provide acceptable access to an anterior of a wearer. Front access portion 16 may comprise one or more disconnectable connection points. As used herein, the term "disconnectable connection point" refers to a point at which two portions of article 11 may be connected in a disconnectable manner. For example, the disconnectable connection point may be a connection provided by a selectably connectable and/or disconnectable fastener. Examples of such fasteners include any suitable fastener known in the art that is configured to reversibly connect two portions of article 11 and are suitable for use in a medical setting. For example, the faster may be selected from the group consisting of a tie, snap, button, fabric hook and loop fastener, zipper, buckle, hook and eye, cord, toggle, brooch, eyelet, and/or combinations of any of the foregoing.

As shown in FIG. 1A, front portion 12 may further comprise one or more side access portions 17*a*, 17*b*. As used in the context of "side access portion," the term "side" refers to a position away from the midline of a wearer. For example, one or more side access portions 17*a*, 17*b* may have a position configured to provide access to one or more surgical sites, for example, one or more surgical incisions and/or one or more drainage sites resulting from a mastectomy.

As shown in FIG. 1A, article 11 may further comprise securing band 110 provided proximal to and secured to at least a portion of an edge of front portion 12, and particular, an edge opposite neckline edge 15. Securing band 110 may be configured to secure article 11 in position on a wearer's body. According to some aspects, securing band 110 may have a width w1 of between about 0.5 and 3 inches, optionally between about 0.5 and 2.5 inches, optionally between about 1 and 2 inches, and optionally about 1.625 inches. As shown in FIG. 1A, the one or more side access portions 17*a*, 17*b* may comprise an opening delineated at least in part by one or more edges 18*a*, 18*b* of front portion 12. The opening(s) may also be delineated at least in part by one or more edges 19*a*, 19*b* of securing band 110. According to some aspects, the opening(s) may have a diameter of between about 1 and 5 inches, optionally between about 1 and 4 inches, optionally between about 1 and 3 inches, and optionally between about 2 and 2.5 inches.

Securing band 110 may comprise any suitable material capable of providing a secure fit against a wearer's body, that is, such that securing band 110 remains relatively fixed in relation to a wearer's body during use. In this way, article 11 may be secured in position on a wearer's body, that is, such that unwanted movement of article 11 relative to a wearer's body may be reduced and/or eliminated. Examples materials useful for securing band 110 may be any suitable material capable of providing a secure and/or adaptable fit, including, but not limited to, elastic, mesh fabrics, nylon, spandex, polyester, cotton, metals, plastics, rubbers, fastener materials (e.g., hook-and-loop fasteners), and combinations thereof.

As shown in FIG. 1A, securing band 110 may comprise one or more detachable band access portions 111*a*, 111*b*. According to some aspects, detachable band access portions 111*a*, 111*b* may comprise one or more disconnectable connection points proximal to side access portions 17*a*, 17*b*, respectively and may facilitate variance of the size or shape of the one or more side access portions 17*a*, 17*b*. For example, detachable band access portions 111*a*, 111*b* may be positioned relative to side access portions 17*a*, 17*b* such that when detachable band access portions 111*a*, 111*b* are in a disconnected position (e.g., wherein the two portions of the disconnectable connection point are not connected to each other), a total surface area of side access portions 17*a*, 17*b*, respectively, is increased (e.g., by displacing edges 19*a*, 19*b* of securing band 110 relative to side access portions 17*a*, 17*b*, respectively, thereby increasing the opening size of side access portions 17*a*, 17*b*). In one non-limiting example (for example, as shown in FIG. 1A), detachable band access portions 111*a*, 111*b* may each comprise a hook and loop fastener provided on securing band 110 at a section proximal to side access portions 17*a*, 17*b*, respectively. In this example, the detachable band access portions 111*a*, 111*b* when placed in a disconnected position may correspond with each hook and loop fastener being in an open position to facilitate displacement of edges 19*a*, 19*b*, respectively, relative to side access portions 17*a*, 17*b*, respectively. It should thus be understood that providing detachable band access portions 111*a*, 111*b* in a disconnected position may facilitate easy access to one or more surgical sites (for example, one or more surgical incisions and/or one or more drainage sites), while providing detachable band access portions 111*a*, 111*b* in a connected position (e.g., wherein the two portions of disconnectable connection point are connected to each other) may secure article 11 in position relative to a wearer's body, as described herein. In one non-limiting example (for example, as shown in FIG. 1A), detachable band access portions 111*a*, 111*b* being placed in a connected position may correspond with each hook and loop fastener being in a closed position so as to secure edges 19*a*, 19*b*, respectively, relative to side access portions 17*a*, 17*b*, respectively. According to some aspects, detachable band access portions 111*a*, 111*b* may comprise one or more selectably connectable and/or disconnectable fasteners as described herein. For example, as discussed above, FIG. 1A shows detachable band access portions 111*a*, 111*b* comprising fabric hook and loop fasteners.

As shown in FIG. 1A, front portion 12 comprises arm edges 112*a*, 112*b*. Together with outer edges 113*a*, 113*b*, respectively, of straps 14*a*, 14*b*, arm edges 112*a*, 112*b* may delineate arm openings, that is, openings through which a wearer's arms may be positioned when the article is worn. According to some aspects, arm edges 112*a*, 112*b* may be posited a certain distance d1, d2 from securing band 110. It should be understood that distance d1, d2 may correspond with a size of the corresponding arm opening of article 11.

According to some aspects, distance d1, d2 may be selected in order to provide an arm opening that is acceptable for mastectomy recovery. For example, distance d1, d2 may have a dimension such that corresponding arm edges 112*a*, 112*b* are provided a certain distance from a wearer's armpit, and in particular, a distance such that one or more surgical sites are exposed when a wearer is wearing article 11. In particular, in the case wherein underarm lymph nodes have been surgically removed from a wearer, it may be preferable that corresponding surgical incisions remain exposed when article 11 is worn by the wearer so as to reduce irritation to the sites and/or to provide access to the sites. According to some aspects, distance d1, d2 may be less than a corresponding distance in similar articles that are not configured for use with mastectomy recovery. That is, arm edges 112*a*, 112*b* of article 11 may be provided further from the armpit of a wearer as compared with arm edges of similar articles that are not configured for use with mastectomy recovery. According to some aspects, distance d1, d2 may independently be, for example, between about 5 and 15 inches, optionally between about 6 and 12 inches, optionally between about 7 and 10 inches, and optionally between about 7.5 and 9 inches.

According to some aspects, front portion 12 may comprise one or more additional features configured for use with mastectomy recovery. For example, front portion 12 may comprise one or more cavities for securing heating and/or cooling elements against a wearer's body, such as pockets.

Figure 1B:
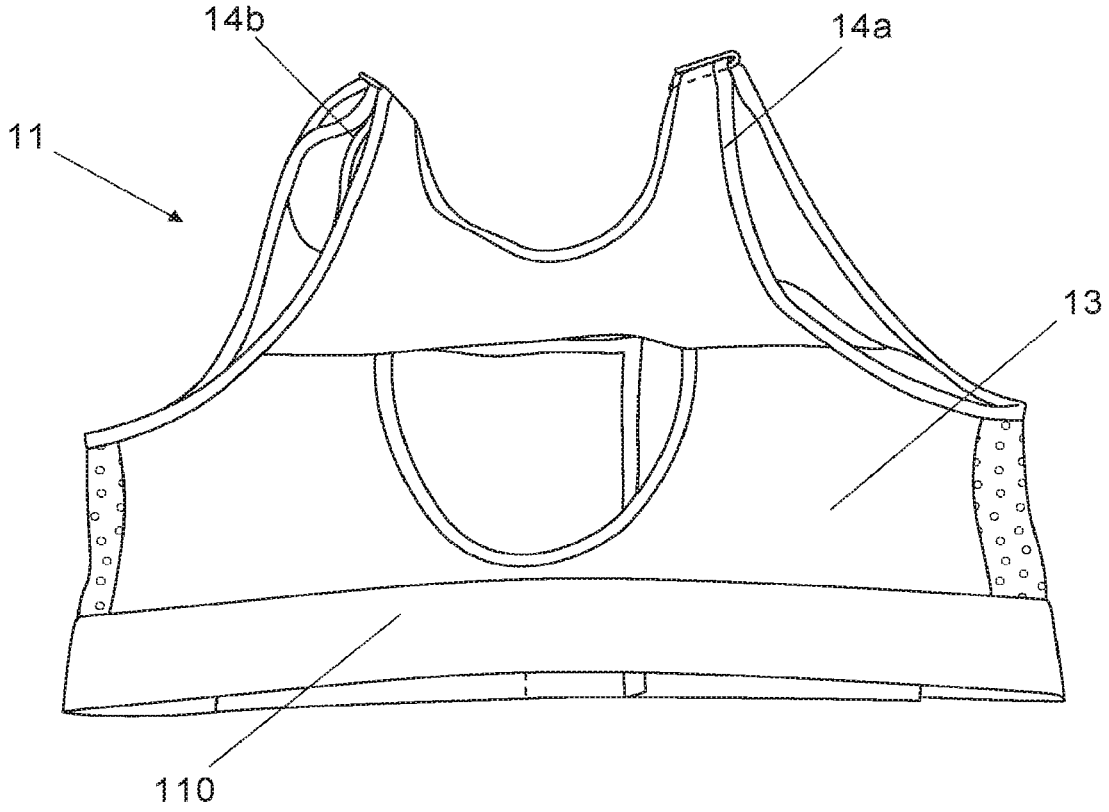
FIG. 1B shows a back side view of an article according to aspects of the present disclosure.

FIG. 1B shows a reverse view of article 11 as shown in FIG. 1A. In particular, FIG. 1B shows back portion 13 of article 11, straps 14*a*, 14*b*, and securing band 110, as described in relation to FIG. 1A. Back portion 13 may comprise any suitable material as described herein. For example, back portion 13 may comprise a material that is similar to the material comprised by straps 14*a*, 14*b*.

Aspects of the present disclosure also relate to methods of making the article as described herein. For example, the method may comprise providing a front portion, providing a back portion in communication with the front portion, providing a securing band proximal and in communication with the front portion and the back portion, and providing one or more straps in communication with the front portion and the back portion, wherein the front portion comprises one or more side access portions, each of the one or more side access portions being delineated by a first edge of the front portion and a second edge of the securing band, and wherein the securing band comprises one or more detachable band access portions, each of the one or more detachable band access portions being in communication with one of the one or more side access portions.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

As used herein, the term "about" and "approximately" and "substantially" are defined to being close to as understood by one of ordinary skill in the art. In one non-limiting embodiment, the term "about" and "approximately" and "substantially" are defined to be within 10%, preferably within 5%, more preferably within 1%, and most preferably within 0.5%.

What is claimed is:

1. An article of clothing configured for use post-surgery, the article comprising: a front portion configured to be worn on a chest of a wearer, a back portion configured to be worn on a back of a wearer, a securing band proximal the front portion and the back portion, the securing band having a length and a width, and one or more straps, wherein the front portion comprises one or more side access portions, each of the one or more side access portions being delineated by a first edge of the front portion and a second edge of the securing band, wherein the securing band comprises one or more detachable band access portions, each of the one or more detachable band access portions being proximal to one of the one or more side access portions, and wherein each of the one or more side access portions comprises an opening having a diameter of between about 1 and 5 inches in a direction parallel the length of the securing band and a height in a direction parallel the width of the securing band, the diameter being greater than the height.

2. The article of claim 1, wherein the surgery is a mastectomy.

3. The article of claim 1, wherein each of the one or more straps comprises an adjustable portion.

4. The article of claim 1, wherein the front portion comprises a front access portion having one or more disconnectable connection points.

5. The article of claim 1, wherein the one or more side access portions are configured to provide access to one or more surgical sites.

6. The article of claim 5, wherein the one or more surgical sites include at least one surgical site resulting from a mastectomy.

7. The article of claim 1, wherein the diameter is between about 2 and 2.5 inches.

8. The article of claim 1, wherein the width of the securing band is between about 0.5 and 3 inches.

9. The article of claim 1, wherein:

the one or more detachable band access portions comprise a first detachable band access portion;

at least one of the one or more side access portions comprises a first side access portion proximal to the first detachable band access portion; and the first detachable band access portion is positioned relative to the first side access portion such that when the first detachable band access portion is in a disconnected position, a total surface area of the first side access portion is increased.

10. The article of claim 9, wherein:

the one or more detachable band access portions further comprise a second detachable band access portion;

at least one of the one or more side access portions further comprises a second side access portion proximal to the second detachable band access portion; and the second detachable band access portion is positioned relative to the second side access portion such that when the second detachable band access portion is in a disconnected position, a total surface area of the second side access portion is increased.

11. The article of claim 10, wherein:

the first detachable band access portion comprises a first fastener;

the second detachable band access portion comprises a second fastener; and the article is secured in a position relative to a wearer's body when the first fastener and the second fastener are in a connected position.

12. The article of claim 11, wherein at least the first fastener is selected from a group consisting of a tie, a snap, a button, a fabric hook and loop fastener, a zipper, a buckle, a hook and eye, a cord, a toggle, a brooch, an eyelet, and combinations thereof.

13. The article of claim 12, wherein the second fastener is selected from a group consisting of a tie, a snap, a button, a fabric hook and loop fastener, a zipper, a buckle, a hook and eye, a cord, a toggle, a brooch, an eyelet, and combinations thereof.

14. The article of claim 1, wherein:

the front portion comprises a first arm edge and a second arm edge;

at least a portion of the first arm edge is located a first distance from at least a portion of a first edge of the securing band;

at least a portion of the second arm edge is located a second distance from the first edge of the securing band; and at least one of the first distance and the second distance is between about 5 and 15 inches.

15. The article of claim 14, wherein the at least one of the first distance and the second distance is between about 7.5 and 9 inches.

16. The article of claim 1, wherein at least one of the front portion, the back portion, the securing band, and the one or more straps is treated with an antimicrobial agent sufficient to provide the article with acceptable antimicrobial properties for surgery recovery.

17. A method for preparing an article, the method comprising: providing a front portion configured to be worn on a chest of a wearer, providing a back portion configured to be worn on a back of a wearer, said back portion in communication with the front portion, providing a securing band proximal and in communication with the front portion and the back portion, the securing band having a length and a width, and providing one or more straps in communication with the front portion and the back portion, wherein the front portion comprises one or more side access portions, each of the one or more side access portions being delineated by a first edge of the front portion and a second edge of the securing band, wherein the securing band comprises one or more detachable band access portions, each of the one or more detachable band access portions being proximal to one of the one or more side access portions, and wherein each of the one or more side access portions comprises an opening having a diameter of between about 1 and 5 inches in a direction parallel the length of the securing band and a height in a direction parallel the width of the securing band, the diameter being greater than the height.

18. The method according to claim 17, wherein:

the one or more detachable band access portions comprises a first detachable band access portion;

the one or more side access portions comprises a first side access portion proximal to the first detachable band access portion; and the first detachable band access portion is positioned relative to the first side access portion such that when the first detachable band access portion is in a disconnected position, a total surface area of the first side access portion is increased.

19. The method according to claim 18, wherein:

the one or more detachable band access portions further comprises a second detachable band access portion;

the one or more side access portions further comprises a second side access portion proximal to the second detachable band access portion; and the second detachable band access portion is positioned relative to the second side access portion such that when the second detachable band access portion is in a disconnected position, a total surface area of the second side access portion is increased.

20. The article of claim 1, wherein the front portion comprises one or more cavities.

* * * * *